United States Patent [19]

Morrison et al.

[11] 4,003,142

[45] Jan. 18, 1977

[54] SCULPTURING KIT AND METHOD FOR PRODUCING DEHYDRATED FORMS FROM HYDRATED ARTICLES

[75] Inventors: Howard J. Morrison, Deerfield; Robert K. Allen, Frankfort, both of Ill.

[73] Assignee: Marvin Glass & Associates, Chicago, Ill.

[22] Filed: Feb. 10, 1975

[21] Appl. No.: 548,251

[52] U.S. Cl. ..... 35/26; 46/15; 46/156; 46/226; 219/220; 219/405; 219/475; 428/15; 428/22

[51] Int. Cl.[2] ..... A63H 9/00; A21B 1/22

[58] Field of Search ..... 35/26; 46/15, 22, 226; 99/444, 537, 541; 219/214, 220, 386, 405, 433, 475; 240/16; 426/104, 383; 428/15, 22

[56] References Cited

UNITED STATES PATENTS

| | | | |
|---|---|---|---|
| 952,941 | 3/1910 | Perkins | 219/220 X |
| 2,434,166 | 1/1948 | Klumpp | 219/220 X |
| 2,500,899 | 3/1950 | Leahan | 46/226 X |
| 2,559,434 | 7/1951 | Hyland | 35/26 X |
| 2,577,184 | 12/1951 | Dietrich | 219/405 X |
| 2,762,893 | 9/1956 | Long | 99/444 X |
| 3,244,872 | 4/1966 | McCormick | 240/16 |
| 3,418,453 | 12/1968 | Sparks | 219/405 |
| 3,610,884 | 10/1971 | Evans | 219/386 X |
| 3,769,495 | 10/1973 | Orfei | 46/226 X |
| 3,822,170 | 7/1974 | Smolen | 240/16 X |

FOREIGN PATENTS OR APPLICATIONS

| | | | |
|---|---|---|---|
| 398,848 | 9/1933 | United Kingdom | 219/220 |

OTHER PUBLICATIONS

"Daffy Dinosaurs", Reliance Corp. Advertisement, p. 70, Aug. 1959, Playthings.

Wolf Cub Scout Book, 1952, p. 143.

Skitzgink, Advertisement by Handy Button Machine Co. p. 187, Feb. 10, 1964, Playthings.

*Primary Examiner*—Harland S. Skogquist

*Attorney, Agent, or Firm*—Coffee and Sweeney

[57] ABSTRACT

A sculpturing kit and method for producing dehydrated sculptured forms from hydrated articles, such as apples or other fruits and vegetables. The sculpture kit includes a transparent heating chamber for mounting an article on a base which includes an incandescent heating source mounted therein. A plurality of templates are provided for use by the sculptor to shape an apple, for instance, into a facial or other form prior to the dehydration process within the heating compartment. The kit also includes a heat drip shield which prevents liquid extracted from the article from contacting the light source, as well as a plurality of sculpturing tools.

11 Claims, 5 Drawing Figures

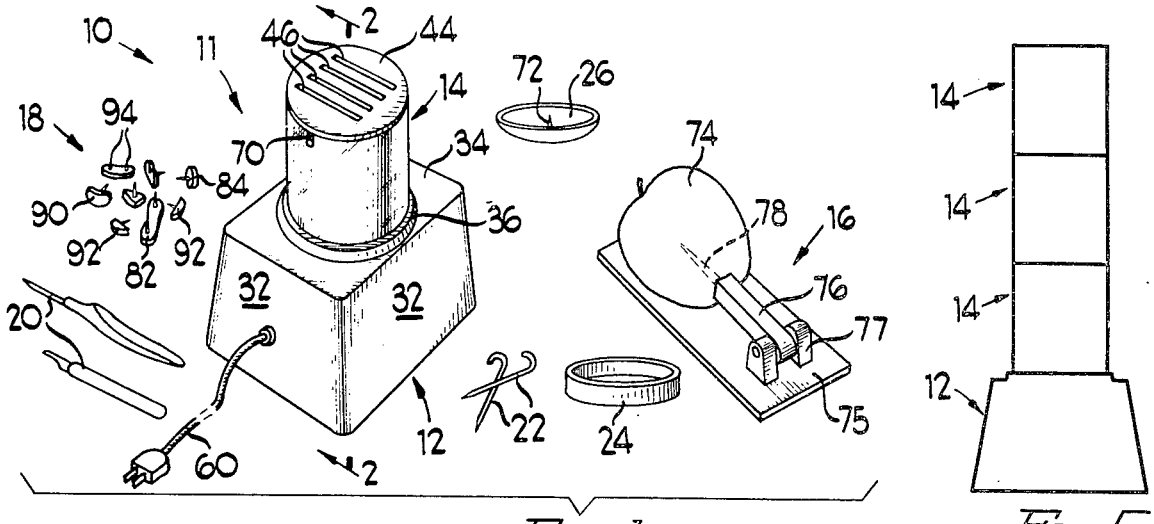
Fig 1
Fig 5
Fig 2
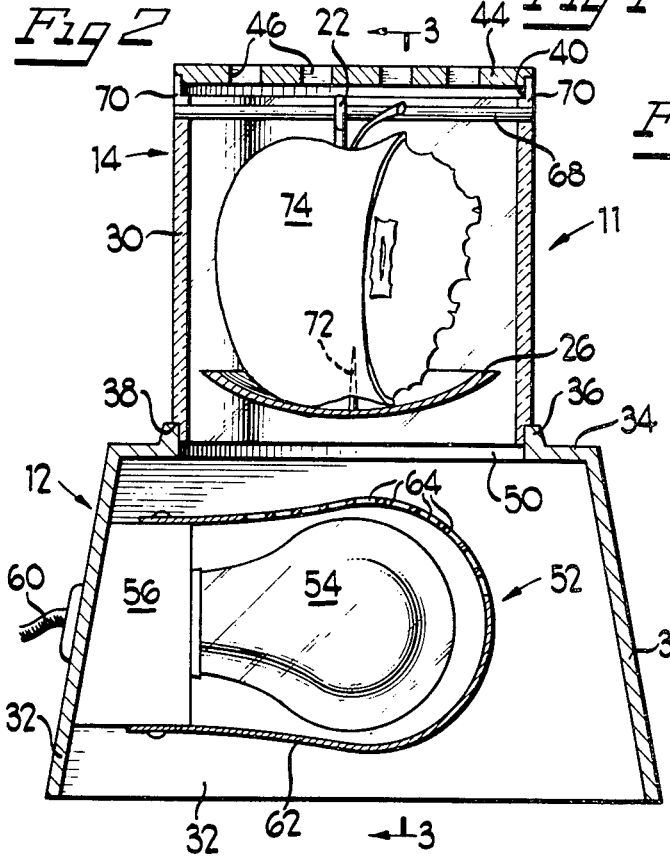
Fig 3
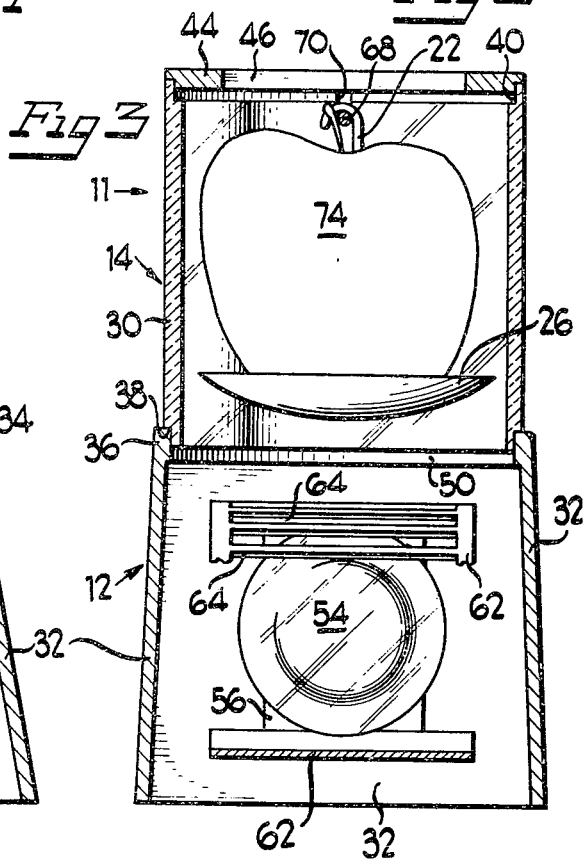
Fig 4
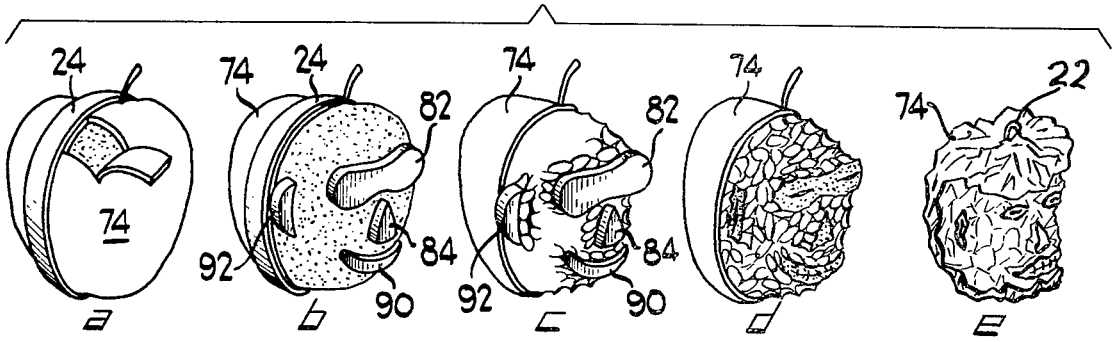

SCULPTURING KIT AND METHOD FOR PRODUCING DEHYDRATED FORMS FROM HYDRATED ARTICLES

BACKGROUND AND SUMMARY OF THE INVENTION

Various sculpturing type kits have been produced in the past, particularly for children, as an aid in making various sculptured forms. One type of such kit includes a plurality of sculpting tools which are used for shaping and sculpturing modeling clay. These kits have proved to be very popular, especially with children, because of the infinite number of designs and shapes or forms which can be created at will. It has also been proposed to use a fruit or vegetable which can easily be carved and shaped into the form of an animal or the like. Such kits included eye pieces, ears, noses, mouths, etc., which can be secured to the fruit or vegetable by means of pins or the like. One inherent feature of fruits and vegetables, which has not been taken advantage of by sculpturing kits, is the fact that the majority of such items contain a large percentage of water. By heating the article subsequent to the preliminary sculpturing thereof, the article can be dehydrated and thus be reduced in size to provide a final sculptured product which is interesting to a child.

An object of the present invention is to provide a new and improved sculpturing kit of the character described which provides for a hydrated article to be carved or sculptured and subsequently dehydrated to produce a generally smaller and lighter sculpture.

In accordance with the object of the present invention, the sculpture kit includes a mounting base portion having a heat source therein and a heating chamber removably positionable on top of the base in a heat transfer relationship with the heat source. A plurality of sculpturing tools are provided to facilitate a preliminary sculpting of a hydrated article, such as an apple, which is thereafter placed in the heat chamber for dehydration. The heat source provided is an incandescent lamp source so that the kit can be safely used by children. The heat from the lamp dehydrates the article causing it to slightly discolor and shrink substantially in size due to the loss of its fluid content. Carving tools, including a holder are provided, along with a plurality of templates. A drip tray is pinned to the underside of the apple prior to heating.

Other objects, features and advantages of the invention will be apparent from the following detailed description taken in connection with the accompanying drawings.

BRIEF DESCRIPTION OF THE DRAWINGS

FIG. 1 is a perspective view of the various components of a sculpturing kit made in accordance with the concepts of the present invention;

FIG. 2 is a vertical section, on an enlarged scale, of the dehydrating components of the sculpturing kit, taken generally along line 2—2 of FIG. 1;

FIG. 3 is a vertical section of the dehydrating components, taken generally along the line 3—3 of FIG. 2;

FIG. 4 is a sequential, perspective view of the sculpturing process as can be performed on an apple, for example; and FIG. 5 is a side elevational view of the dehydrating components of the present invention shown, using a plurality of stackable heating chambers.

DESCRIPTION OF THE PREFERRED EMBODIMENT

Looking at FIG. 1, the sculpturing kit, generally designated 10, of the present invention includes a dehydrator, generally designated 11, having a base portion, generally designated 12, and a heating chamber, generally designated 14. Also provided are a sculpturing stand or holder, generally designated 16, and a plurality of sculpturing templates, generally designated 18. The sculpturing kit is provided with a pair of sculpturing tools 20, a pair of hanging devices 22, a circular template 24 and a drip pan 26, as will be described below.

Referring to FIG. 2, the heating chamber, generally designated 14, comprises a transparent cylindrical portion 30 which is mounted on the base 12. The base 12 comprises four upstanding wall portions 32 which support a unitary mounting platform 34 at their uppermost disposed ends. A generally vertical, circular upstanding flange 36 mounts the heating chamber 14 by an outwardly disposed circular notch 38 formed around the bottom of the heating chamber. The top of the heating chamber 30 includes an inwardly disposed notch 40 for mating with the notch 38 of another heating chamber 14 so that a plurality of heating chambers may be stacked one upon the other, as shown in FIG. 5, for more efficient use of the sculpturing kit. The top of the heating chamber is closed by a disc 44 which includes a plurality of slotted louvers 46 which permit for the escapement of heat from the heating chamber, as will be described in detail below.

Internally of the flange 36 on the platform 34 is a large circular opening 50 which is approximately equal to the inside diameter of the heating chamber 14. Directly below the aperture 50 is mounted a heat source, generally designated 52. The heat source 52 comprises a conventional incandescent lightbulb 54 which is mounted in a socket 56 secured to one side wall 32 of the base. The bulb should be of reasonably low wattage so as not to be of danger to a child to cause burns, but of sufficient power to create the required heat to facilitate the dehydration process. An electrical wire 60 extends through the base wall 32 to provide power to illuminate the lightbulb. A heat directing and safety shield 62 is mounted on the bulb socket 56 for substantially surrounding the bulb 54 to prevent accidental injury which could be caused by someone touching the bulb, and also to reflect a portion of the light and heat radiated in the downward direction toward an upward direction. The upper portion of the shield 62 includes a plurality of louvers 64 which permit the escapement of light and particularly heat upwardly into the heating chamber 14 through the opening 50.

The article to be heated, and thereby dehydrated, is mounted in the heating chamber by one of the mounting hooks 22 which is stuck into the article and suspended upon a rod 68 mounted in two generally vertical slots 70 provided in the uppermost end of the heat chamber 14. The drip shield 26 is generally concave and includes an upstanding pin 72 in the center lowermost portion thereof for securing to the bottom of the article to be dehydrated to catch any fluids and prevent them from contacting the light source 54 or the shield 62.

For purposes of illustration, the sculpturing process which can be accomplished with the sculpturing kit 10 of the present invention will be described with reference to an apple 74 shown in FIGS. 1–3 and in sequence in FIG. 4. The kit 10 includes the sculpturing stand 16 which is used to support the apple during the preliminary sculpturing. The stand includes a flat base 75 which pivotally mounts a support arm 76 by means of a hinge 77. The support arm includes a pin 78 for insertion into an article and mounting the article to be sculptured.

Referring now to the sequence of FIG. 4, FIG. 4*a* shows the use of the circular template 24 for surrounding the apple 74 generally about the central circumference thereof, which permits and facilitates the peeling or removing the skin from a portion of the apple as is seen in FIG. 4*a*.

In the embodiment shown herein, approximately one-half of the apple is to be peeled, as illustrated by the use of the template 24. The templates 18 are provided in order to aid the user in sculpturing the apple. A template 82 represents a pair of eyes, template 84 represents a nose, template 90 represents a mouth and a pair of templates 92 represent a pair of ears. All of the templates include at least one pin 94 which permits the templates to be fastened onto the apple by pushing the pin 94 into the apple as shown in 4*b*.

Referring to FIG. 4*c*, the sculptor then uses one of the sculpturing tools 20 to decrease the volume of the apple by cutting away a portion of the fruit, only in those areas which are not covered by the template or the skin of the apple. Therefore, referring to FIG. 4*d*, after removal of the templates 18, the areas covered thereby will extend substantially outwardly of the remaining area which has been cut away. At this time, it may be desirable to produce additional effects by forming teeth, eyesockets and earholes within the above described areas.

Now that the sculpturing is completed, the article is ready to be dehydrated by the dehydrator 11, as shown in FIGS. 2 and 3. Although it is possible to immediately heat treat the article as shown in FIG. 4*d*, it has also been discovered through various tests that the dehydration process can be quickened if the article, in this case an apple, is first soaked in a solution of vinegar and water. The solution which is used prior to heat treatment will of course vary according to the particular article.

After the drip shield 26 has been attached, the article is suspended on the rod 68 by one of the hooks 22. The article is therefore suspended directly above the light source 54 which causes a substantial amount of heat to radiate upwardly toward the article, in this case the apple. After a predetermined period of time, which can easily be determined since the sculptor can watch the dehydration process through the transparent heating chamber 14, the heat source is disconnected and the finished sculpture can be removed. The finished sculpture is seen in FIG. 4*e* to be shrunk and substantially reduced in size due to the fact that some of the fluids have been removed in the heating dehydration process. It will also be seen in FIG. 4*e* that the resultant sculpture is interestingly shaped in that the peeled area where the body or pulp of the apple has been somewhat removed shrinks or dehydrates faster than the area still having the protective outer peel.

For convenience, as described earlier, with reference to FIG. 5, a number of users can simultaneously sculpture their articles and likewise dehydrate them by use of a plurality of stacked heat chambers 14.

The foregoing detailed description has been given for clearness of understanding only and no unnecessary limitations should be understood therefrom as some modifications will be obvious to those skilled in the art.

We claim:

1. A sculpturing kit for use with a hydrated article, such as a fruit or vegetable, for forming dehydrated sculptures from said articles, comprising, in combination:

a base structure including a heat source mounted within the base;

at least one heating chamber removably mounted on the base in a heat transfer relationship with the heat source therein;

at least one implement for sculpturing the article;

template means to assist the user in sculpturing the desired shape of the article prior to dehydration, said template means including a plurality of individual templates, each template having at least one pin for puncturing the article to mount the template thereon, said templates being in the form and shape of various facial features to permit sculpturing of the article therearound to provide more distinguishable facial characteristics on the article; and means for mounting the article in the heating chamber, said mounting means including a generally horizontal rod mounted generally at the top of the heating chamber and means for embedding within the article including an extended member for supporting the article in a hanging position from the horizontal rod out of contact with any portion of the heating chamber whereby heat derived from the heat source partially dehydrates the article to form a sculpture.

2. The sculpturing kit of claim 1 wherein the heat source is a low wattage incandescent lightbulb.

3. The sculpturing kit of claim 1 wherein the heating chamber is formed by a generally cylindrical transparent wall to permit visual observation of the article from any angle during the dehydration process.

4. The sculpturing kit of claim 1 including means formed integrally with the base to catch and prevent liquid which is exacted from the article from contacting the heat source.

5. The sculpturing kit of claim 1 including a plurality of heating chambers including means for removably mounting the same on top of one another and on the base and air passage means therethrough to permit the dehydration of a plurality of articles simultaneously.

6. A sculpturing kit for use with a hydrated article, such as a fruit or vegetable having an outer peeling, for forming dehydrated sculptures, comprising, in combination:

a base having a heat source mounted thereon;

a heating chamber removably mounted on the base in heat transfer relationship with the heat source;

means for removing the outer peeling from a portion of the surface of the article;

template means for placing onto the peeled area of the article and about which part of the body of the article may be removed to form the peeled area into a desired shape; and hanger means for suspending the article in the heating chamber, said hanger means including mounting means generally at the top of the heating chamber and depending means for embedding within the article including an extended portion for supporting the article in a hanging position from the mounting means out of contact with any portion of the heating chamber whereby heat derived from the heat source partially dehydrates the article to form a sculpture.

7. The sculpturing kit of claim 6 wherein the template means includes a plurality of individual templates having means for mounting on the article, said templates being in the form and shape of various facial features to permit sculpturing of the article therearound prior to dehydration to provide more distinguishable facial characteristics on the article subsequent to dehydration.

8. The sculpturing kit of claim 6 wherein the heating chamber is formed by a generally cylindrical transparent wall to permit visual observation of the article from any angle during the dehydration process.

9. The sculpturing kit of claim 6 wherein said mounting means comprises means for suspending the article within said heating chamber and including a drip tray having means for mounting the same directly to the underside of the article for receiving liquids which may drip from the article.

10. The sculpturing kit of claim 6 including a plurality of heating chambers including means for removably mounting the same on top of one another and on the base and air passage means therethrough to permit the dehydration of a plurality of articles simultaneously.

11. A method for producing sculptures from a hydrated article, such as a fruit or vegetable having an outer peeling, comprising, the steps of:

removing the outer peeling from a portion of the surface of the article;

placing template means in at least a portion of the peeled area of the article;

forming that portion of the article having the outer peeling removed into a desired shape, by removing portions of the article in the peeled area about the template means;

heating the article to facilitate the dehydration thereof whereupon the article is shrunk, particularly in the peeled area thereof.

* * * * *